US005135692A

United States Patent [19]

Serafini

[11] Patent Number: 5,135,692

[45] **Date of Patent: * Aug. 4, 1992**

[54] FORM FOR PATTERNED CONCRETE

[75] Inventor: Franco L. Serafini, Leudelange, Luxembourg

[73] Assignee: E. I. Du Pont de Nemours and Company, Wilmington, Del.

[ * ] Notice: The portion of the term of this patent subsequent to Jun. 23, 2009 has been disclaimed.

[21] Appl. No.: 698,991

[22] Filed: May 14, 1991

Related U.S. Application Data

[63] Continuation of Ser. No. 472,902, Jan. 31, 1990, abandoned, Continuation-in-part of Ser. No. 438,044, Nov. 20, 1989, abandoned.

[51] Int. Cl.[5] ..... B28B 7/36; B28B 1/26; E04G 9/10

[52] U.S. Cl. ..... 264/86; 249/113; 249/134; 249/141; 249/189; 264/219

[58] Field of Search ..... 249/113, 134, 141, 189; 264/86, 87, 219; 425/84, 85; 29/448, 449

[56] References Cited

U.S. PATENT DOCUMENTS

| | | | |
|---|---|---|---|
| 2,310,391 | 2/1943 | Brooks et al. | 249/114.1 |
| 2,628,402 | 2/1953 | Billner | 249/113 |
| 2,671,940 | 3/1954 | Billner | 425/85 |
| 2,688,175 | 9/1954 | Billner | 425/85 |
| 3,477,103 | 11/1969 | Troth, Jr. | 19/163 |
| 3,600,771 | 8/1971 | Dyrander | 425/85 |
| 3,726,950 | 4/1973 | Turzillo | 264/86 |
| 3,780,975 | 12/1973 | Turzillo | 249/113 |
| 3,821,062 | 6/1974 | Henderson | 428/113 |
| 3,991,244 | 11/1976 | Debbas | 428/113 |
| 4,213,926 | 7/1980 | Toyoda et al. | 264/74 |
| 4,335,065 | 6/1982 | Ando | 264/87 |
| 4,730,805 | 3/1988 | Yokota et al. | 249/113 |
| 4,787,597 | 11/1988 | Yokota et al. | 249/113 |
| 4,856,754 | 8/1989 | Yokota et al. | 249/113 |

FOREIGN PATENT DOCUMENTS

| | | | |
|---|---|---|---|
| 53441 | 5/1912 | Australia | 249/113 |
| 1-198305 | 8/1989 | Japan | 249/127 |
| 2158767 | 11/1985 | United Kingdom . | |

OTHER PUBLICATIONS

Typar ® Report 6, *Dam Construction on the River Euphrates. A smooth improvement* (Nov. 1988).

IABSE Symposium Report, "Improvement of Surface Quality of Concrete Structures by Unique Framework", Tanaka et al., (Sep. 1987).

Nikkei New Materials, No. 32, pp. 117-120, Aug. 1987 (partial translation 3rd row, line 9, p. 117 to 1st row, line 9, p. 118).

DuPont Zemdrain Bulletin (1990)-For High-Quality Concrete Surfaces.

*Primary Examiner*—Jay H. Woo
*Assistant Examiner*—Khanh P. Nguyen

[57] ABSTRACT

A concrete form with provision for draining excess water and air from wet concrete by placing fabric over a grid on the support portion of the form. A patterned surface of increased hardness results from use of the form. One embodiment results in concrete with a completely smooth surface.

11 Claims, 2 Drawing Sheets

FORM FOR PATTERNED CONCRETE

This is a continuation of application Ser. No. 07/472,902, filed Jan. 31, 1990 now abandoned, which is in turn a continuation-in-part application based on Ser. No. 07/438,044, filed Nov. 20, 1989, now abandoned.

BACKGROUND OF THE INVENTION

1. Field of the Invention

This invention relates to forms for concrete manufacture and to forms which yield patterned or very smooth concrete surfaces.

2. Description of the Prior Art

U.S. Pat. No. 4,730,805, issued Mar. 15, 1988 on the application of Yokota et al., discloses a form for forming concrete which utilizes a support and at least two layers of fabric over the support. The support can have lugs to space the fabric from the support and the fabric layers and the lugs assist in draining water away from the curing concrete. The support may have drainage holes for removal of excess water and air. The fabric is bonded to the support and is stiff and immovable relative to the support.

U.S. Pat. No. 4,856,754 issued Aug. 15, 1989 on the application of Yokota et al, discloses a concrete form using double-woven fabrics on a support plate with holes to provide water drainage. One woven fabric is adhered to the plate and the other woven fabric is sewn to the first.

SUMMARY OF THE INVENTION

The present invention provides a concrete form for making concrete with a patterned surface wherein the form has a support means, a grid with interconnected spacing members which form holes in the grid and at least a portion of which rest against the support means, and a porous fabric juxtaposed with the grid and set apart from the support means by the grid. A form for making concrete with a very smooth surface is provided, either wherein the grid has very small holes, or wherein the grid is omitted and the porous fabric is stretched, at a uniform, continuous, tension over the support means. A form for making concrete is also provided wherein the support and the grid are combined to be a support means having holes.

There is, also, provided a process for making the form by establishing a support with the shape desired for a concrete article to be made, affixing a grid to the support wherein the grid has interconnected spacing members at least a portion of which rest against the support, and juxtaposing a porous fabric with the grid, set apart from the support by the grid. The process of this invention also includes establishing a support means with holes and juxtaposing a porous fabric with the support means.

DETAILED DESCRIPTION OF THE INVENTION

Concrete which is cast using a concrete form takes the surface of the form. The wet concrete is poured into or against the concrete form and, upon setting and removal of the form, the newly-exposed concrete surface is a reverse impression of the inner surface of the form. In the case of wooden forms, the concrete takes on the appearance of wood grain; and in the case of forms involving seamed form members, the concrete shows any seams which have not been masked.

Air is often added to a concrete mix and water is often added in excess to that amount required for hydration. Such air and water are useful to render the mix flowable and to facilitate handling and pouring. The water, if left undrained, results in concrete having a weakend surface and, the air, if not removed, results in surface pores as large as 0.1 to 3 centimeters, which pores leave an uneven surface open to the effects of dirt and erosion by freeze-thaw cycles of water.

It is often desirable to achieve a smooth, unblemished, concrete finish; and it would often be even more desirable to achieve a patterned surface with some aesthetic appeal. Finishing or smoothing operations on concrete surfaces are difficult and expensive; and patterning requires substantial time and effort. It has now been discovered that smooth and patterned concrete surfaces can be made without finishing operations. Moreover, it has been discovered that such smooth and patterned surfaces have qualities which are improved over concrete surfaces of the prior art.

This invention results in concrete having a surface with patterns constituted by convexities or raised areas. In a special embodiment, it also results in concrete with a completely smooth surface. This invention comprises a concrete form which utilizes a support, a grid, and a porous fabric.

Figure 1:
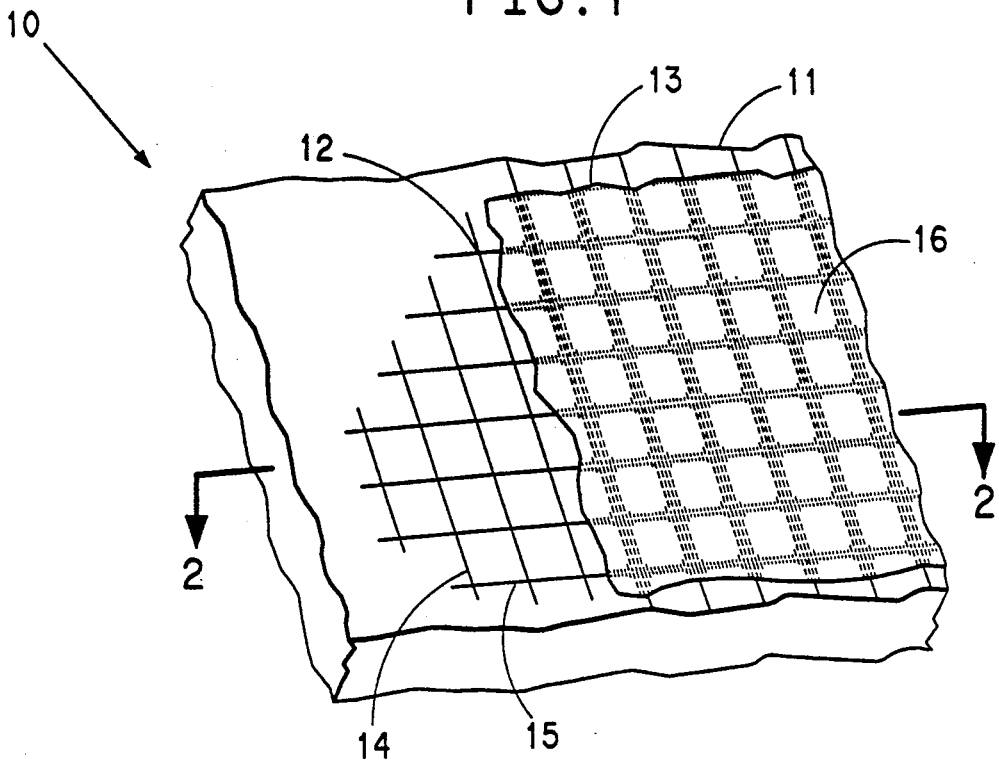
FIG. 1 is a representation of a form of this invention, in partial section, with grid and porous fabric.

Referring to FIG. 1, concrete form 10 includes support 11 which can be of any material which has been traditionally used as a material for concrete forms. Support 11 must have enough strength to support the weight of the wet concrete before curing. The support can be of wood or it can be of metal or plastic; and, while it should be relatively smooth, for use in making concrete with a patterned surface, the smoothness is not critical.

Grid 12 can be of any noncompressible material such as wire screening or plastic netting. The grid can have holes of any regular or irregular shape or size, defined by interconnecting spacing members 14 and 15. Any shape—round, square, triangular, or irregular—can be used; and it is preferable that the area of the holes should be greater than about 0.25 square centimeters and less than about 2500 square centimeters. Different sizes of holes can be used in a given application for any desired purpose. The area of the holes can be large enough that there is opportunity for fabric 13 to be pressed through the holes by wet concrete to contact support 11, or the holes can be so small and fabric 13 can be drawn so taut that the fabric is not deformed enough by pressure of the concrete mix to reach the surface of support 11. The grid 12 should have a thickness of from about 0.2 to 50 millimeters. The limits of the thickness are a matter of convenience and practicality. The thickness should be great enough to permit flow of water and air from the body of wet concrete and not so thick that there is excess distance between the support and porous fabric 13 juxtaposed with grid 12. Grid 12 can be made in such a way that interconnecting spacing members 14 and 15, either lie in the same plane, or lie on top of one another by being woven or not. It is preferred that the grid be composed of interconnected spacing members in which crossing elements are woven such that the crossing elements lie atop one another at points of intersection.

Porous fabric 13 can be woven or nonwoven and can be made from natural or synthetic materials. The preferred material is thermo-bonded polyolefin fabric having a basis weight of about 20 to 600 grams per square meter. Pores in the fabric should be at least 10 microns and less than about 300 microns, that is, of a size to permit passage of water and air but to prevent passage of substantially all solid particles in a concrete mix. It is preferred that the fabric have pore sizes from about 15 to 200 microns in diameter. The fabric can be of any convenient thickness; but it must be adequate to withstand the high pressures brought against it by the wet concrete. It is preferred that the fabric should be at least 0.5 millimeter thick.

Figure 2:
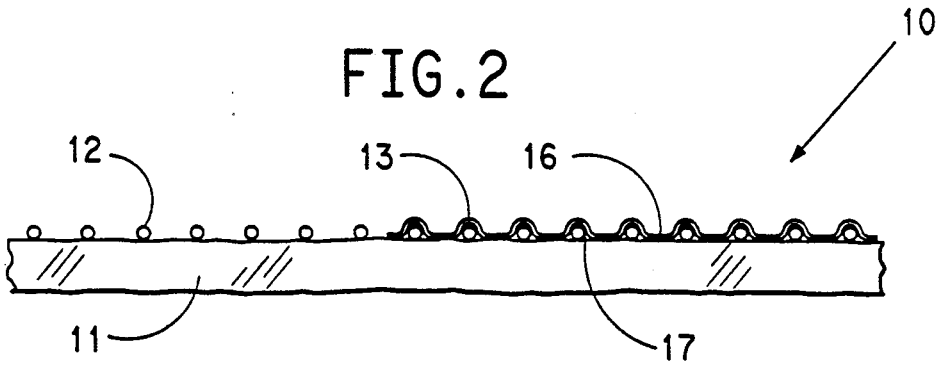
FIG. 2 is a cross section of the form from FIG. 1.

Referring to FIG. 2, concrete form 10 is made by affixing grid 12 against support 11 which has been established to have the shape desired in a final concrete article, and then juxtaposing porous fabric 13 with the grid. The grid 12 need not be closely affixed to support 11 but it must be affixed to the degree required to assure that it will remain in place during use of the form. Likewise, porous fabric 13 need not be closely affixed to grid 12; but merely juxtaposed therewith. For forms wherein the intended concrete article has a patterned surface, the fabric 13 can be effectively juxtaposed by use of staples or small nails placed periodically at relatively large distances at the edge or backside of the form. It has been determined that the fabric should not be closely attached to the grid. By the word "juxtaposed" is meant that fabric 13 should be placed against grid 12; but that the surface of one should not be bound to the surface of the other.

As porous fabric 13 is juxtaposed with grid 12, both against support 11; and, as concrete is poured into the form, the concrete presses porous fabric 13 into the holes in grid 12 and against support 11, causing depressions 16 along with channels 17. As a result of pressing into the fabric 13 to make depressions 16, the concrete will form one convexity for each depression 16. When the grid is made in such a way that the depressions form a pattern of any kind, whether regular or irregular, the concrete will form a mating pattern of convexities. Water and air will pass through porous fabric 13, into channels 17, and away from the concrete.

Figure 3:
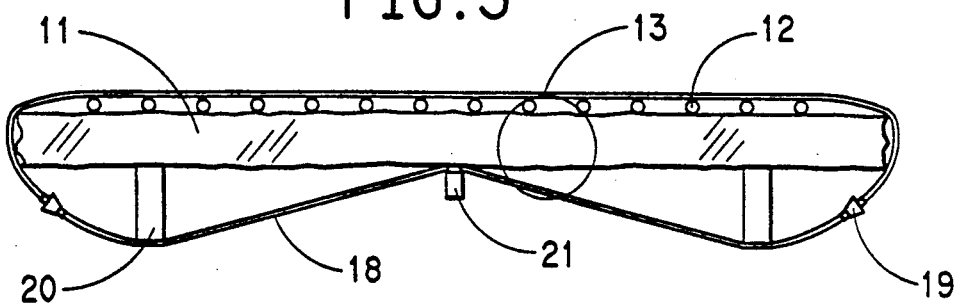
FIG. 3 is a cross section of a form having the porous fabric under uniform tension over the grid.

As one particular embodiment, and looking to FIG. 3 for detail, when porous fabric 13 is held with continuous, uniform, force such that it is stretched uniformly over grid 12, a completely smooth concrete surface can be made. Making a completely smooth concrete surface is difficult due to the difficulty in holding fabric 13 without wrinkles during the concrete pouring process. This is because support 11 and fabric 13 may shrink or expand due to changes in temperature or humidity. It has been determined that as little as ½% of shrinkage or expansion in either the support or the fabric is enough to cause wrinkles in the fabric and consequent irregularities in the concrete surface. It should be pointed out that, in the case where patterned concrete surfaces are being made by this invention, the effects of shrinkage and expansion are taken up in the depressions. However, when completely smooth concrete surfaces are desired, the grid must be so small that no depressions form. That is, for completely smooth concrete surfaces, the grid should have interconnected spacing members forming holes less than 0.25 $cm^2$. Continuous, uniform, force is applied to fabric 13 by connecting elastic or resilient members 18 to edges of fabric 13 by means of grippers 19. Members 18 can be springs or they can be made from rubber or some other elastomer. Members 18 are brought over risers 20 and attached to anchor 21. Of course, any arrangement of members is acceptable which results in tension applied to fabric 13. A multitude of members 18 can be attached to fabric 13, thereby assuring continuous, uniform, tension over the expanse of fabric. It has been determined that a tension of 0.2 to 3.0 kg/lineal cm is adequate for the practice of this invention. It should be understood that the tension can be applied in any manner which is effective to yield the proper result.

When a completely smooth support 11 is used, there is no need for any grid in the making of concrete with a completely smooth surface, so long as fabric 13 is stretched over the support at a uniform tension, as described above.

Figure 4:
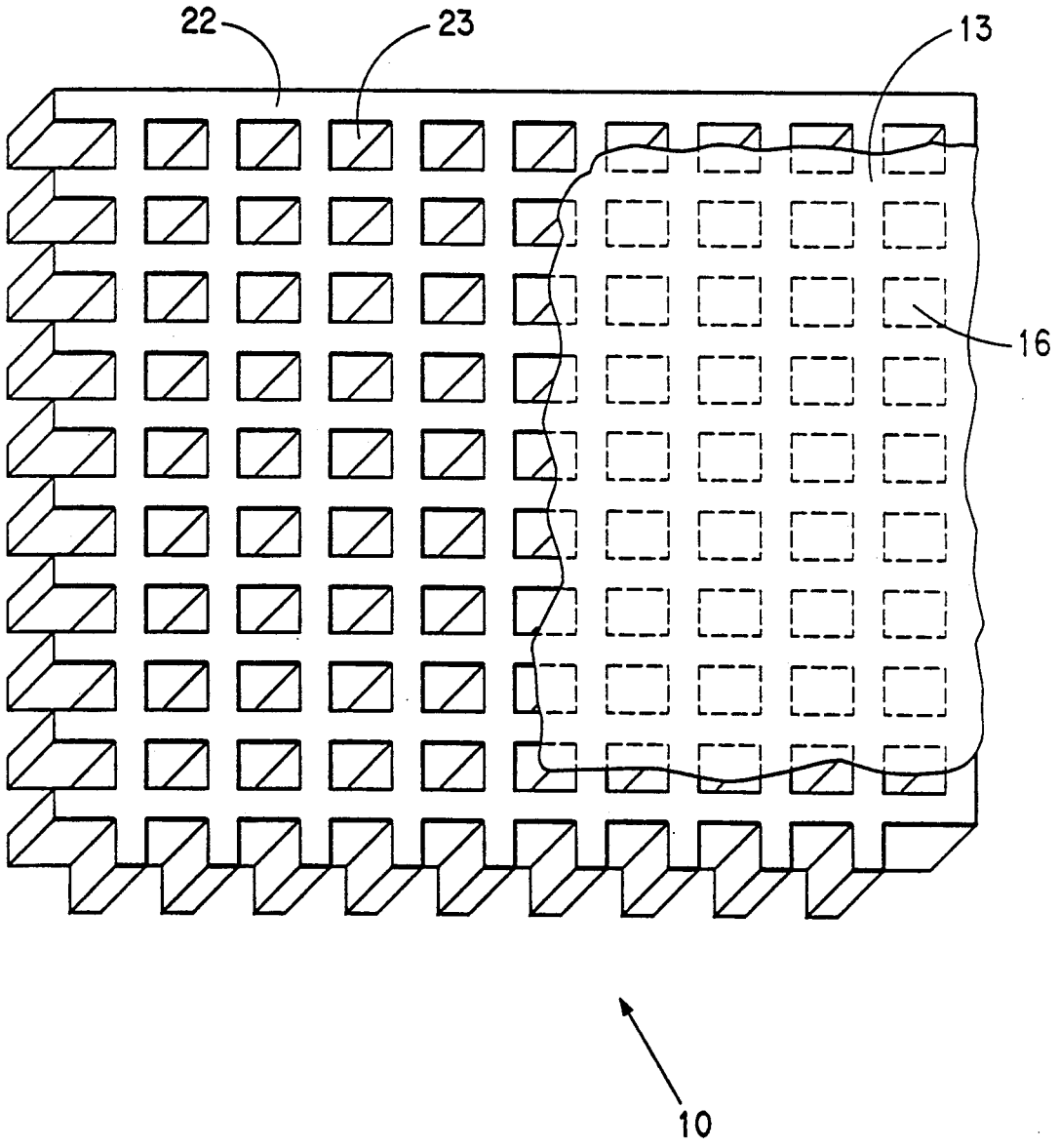
FIG. 4 is a representation of another form of this invention, in partial section, with support means having holes and porous fabric.

Referring to FIG. 4, concrete form 10 includes support means 22 with holes 23. Support means 22 can be of any material for concrete forms, however, it must have enough strength to support weight of the wet concrete before curing. The support means can be of wood or it can be of metal or plastic.

The holes in support means 22 must be deep enough to permit drainage of air and water from the concrete mix and preferably extend through the thickness of the support means. The holes can be of any regular or irregular shape or size; and should be greater than about 0.25 square centimeters and less than about 2500 square centimeters.

Porous fabric 13 can be juxtaposed with support means 22 and the concrete mix will cause depression 16 in the same way that they are formed using the form of FIG. 1 with a separate grid.

As an added benefit, the form of this invention can be dismantled sooner after pouring the concrete than forms of the prior art. A post-curing of concrete using the form of this invention can be accomplished by removing the support and grid after only a day or two and leaving the fabric on the concrete to prevent premature drying. In fact, the fabric can be sprayed with water to enhance the post-curing treatment.

It has, also, been discovered that fine denier nylon fabric can be used to modify the surface color of concrete made using the form of this invention. Such nylon fabric is positioned as a layer between the grid or support and the porous fabric or between the support means and the porous fabric in set-up of the concrete form. The cured concrete resulting from use of the nylon fabric has a surface which is substantially darker in color than the surface of concrete made without the nylon. The nylon fabric can be woven or nonwoven and, if nonwoven can be needlepunched or spunbonded. The nylon fabric can be positioned loosely between the grid or support and the porous fabric or it can be attached directly to the porous fabric. For example, the nylon fabric can be needlepunched into the porous fabric. A darker concrete surface is believed to represent concrete of higher quality and is preferred.

DESCRIPTION OF THE PREFERRED EMBODIMENTS

As a test, a wooden form was made using small pieces of wood for a panel 2 by 2.5 meters. A concrete panel made using that form had an uneven surface appearance which mirrored the grain and seams of the wood; and the concrete surface included small cavities caused by air bubbles which could not escape from the form. Moreover, before each subsequent use, the form had to be repaired, cleaned, and sprayed with release oil.

As a practice of the present invention, the same form was used as the support; and a grid with holes 15 by 15 centimeters was attached to the support by means of small nails. Porous fabric was placed over the grid by means of elastic members as shown in FIG. 3. The tension on the fabric was about 0.05 kg/lineal centimeter. The porous fabric was a thermo-bonded polypropylene sheet material with a basis weight of about 290 grams/square meter sold under the tradename "Typar" by Du Pont de Nemours S.A., Luxembourg.

Concrete made using the form of this invention exhibited a uniform dark color and no surface porosity. Concrete made using the wood form only, without the benefit of this invention, exhibited a nonuniform lighter color and easily visible pores or surface cavities ranging in size from 1 to 15 millimeters or more. The surface of the concrete made using the form of this invention was determined to have a hardness 30% higher than the surface of the concrete made using the wood form. The surface hardness was measured by means of a Schmidt-Hammer tester.

The surface of the concrete using the form of this invention exhibited a regular pattern of slight bulges the same size as the holes of the grid.

Concrete walls made in the same manner, with the same form and with the same porous fabric, but with grids having holes of 9 by 9, 5 by 5, and 2 by 2 centimeters, gave the same high quality concrete with the same high quality surfaces as were made in the test first described above.

When the same wood support was used with a grid of 5 by 5 centimeters and a thermo-bonded polypropylene fabric of basis weight 136 grams/square meter, the same high quality concrete was made with the same high quality surface, except that the depressions for the fabric were more pronounced which resulted in bulges (convexities) in the surface of the concrete which were more pronounced.

A grid with holes of 5 by 5 millimeters was used in the form as described above with the fabric having a basis weight of 136 grams/square meter and with a tension of 1 kg/lineal centimeter applied as shown in FIG. 3. The holes in the grid were small enough and the tension was continuous and uniform and great enough that the surface of the resulting concrete was almost completely smooth, with only a barely detectable pattern from the grid.

In a further test, fabric having a basis weight of 290 grams/square meter was used, and was fixed on a flat, smooth plywood form without any grid, but with 1.5 kg/lineal centimeter tension applied in both directions.

The resulting concrete was absolutely flat, free of fold marks and of the same quality described above.

Another test was conducted using the same conditions as in the above test; but, on the surface of fabric to be against the concrete, a transferable printing was applied using an ink with a base of glycol ethers and alcohols. The ink dissolved in the concrete and the printing was transferred from the fabric to the concrete at the same time that the concrete was made. This test shows the preparation of fully acceptable decorative concrete panels made in a single step, instead of making the panel, finishing the concrete, and then painting it.

I claim:

1. A concrete form for making a patterned surface comprising:

a) a support means;

b) a grid having interconnected spacing members which form holes in the grid and at least a portion of which rest against the support means, the holes having an individual area of at least 0.25 $cm^2$ to create the patterned concrete surface;

c) a porous fabric juxtaposed, but not attached to, the grid and set apart from the support means by the grid; and d) fabric stretching means to continuously stretch the porous fabric uniformly over the grid throughout the concrete making process.

2. The concrete form of claim 1 wherein the holes of the grid have an individual area of less than 2500 $cm^2$.

3. The concrete form of claim 1 wherein the grid has a thickness of from 0.2 to 15 millimeters.

4. The concrete form of claim 1 wherein the porous fabric is nonwoven.

5. The concrete form of claim 4 wherein the nonwoven fabric has pores of a size to permit passage of water and air but to prevent passage of substantially all solid particles in a concrete mix.

6. The concrete form of claim 4 wherein the nonwoven fabric has pores 15 to 200 microns in average diameter.

7. The concrete form of claim 4 wherein the nonwoven fabric is thermo-bonded polyolefin.

8. A process for making a concrete form used in making a patterned concrete surface comprising the steps of:

a) establishing a support having the shape desired for a concrete article to be made;

b) affixing a grid to the support wherein the grid has interconnected spacing members which form holes in the grid and at least a portion of which rest against the support, the holes having an individual area of at least 0.25 $cm^2$ to create the patterned concrete surface;

c) juxtaposing, but not attaching, a porous fabric to the grid, the fabric set apart from the support by the grid; and d) continuously stretching the porous fabric uniformly over the grid throughout the concrete making process.

9. A concrete form for making concrete having a smooth surface comprising:

a) a support with a smooth surface;

b) a porous fabric juxtaposed with, but not attached to, the smooth surface of the support; and c) fabric stretching means by which the porous fabric is continuously stretched over the support at a uniform tension of 0.2 to 3.0 kg/lineal cm throughout the concrete making process.

10. The concrete form of claim 9 wherein there is a grid positioned between the support and the porous fabric and wherein the grid has interconnected spacing members forming holes in the grid with an individual area of less than 0.25 $cm^2$.

11. A concrete form for making a patterned surface comprising:

a) a support means having holes with an individual area of at least 0.25 $cm^2$ to create the patterned concrete surface;

b) a porous fabric juxtaposed with, but not attached to, the surface of the support means; and c) fabric stretching means to continuously stretch the porous fabric uniformly over the support means throughout the concrete making process.

* * * * *